US007930859B1

(12) United States Patent
Eslambolchi et al.

(10) Patent No.: US 7,930,859 B1
(45) Date of Patent: Apr. 26, 2011

(54) REPLACEMENT CABLE MARKER POLE HAVING ROTATABLE COLLAR FOR ATTACHMENT OF POLE TO BASE

(75) Inventors: Hossein Eslambolchi, Los Altos Hills, CA (US); John Sinclair Huffman, Conyers, GA (US); Gene Geren, Good Hope, GA (US)

(73) Assignee: AT&T Intellectual Property I, L. P., Atlanta, GA (US)

( * ) Notice: Subject to any disclaimer, the term of this patent is extended or adjusted under 35 U.S.C. 154(b) by 426 days.

(21) Appl. No.: 11/081,026

(22) Filed: Mar. 15, 2005

(51) Int. Cl.
*E01F 9/013* (2006.01)
*E01F 9/017* (2006.01)
*F16M 13/00* (2006.01)

(52) U.S. Cl. ..... 52/103; 40/608; 40/607.04; 40/607.1; 248/519; 248/160; 248/159

(58) Field of Classification Search ..... 52/726.1, 52/726.3, 726.4, 736.1, 736.3, 736.4, 737.5, 52/103; 404/10; 40/607.01, 607.04, 608, 40/612, 607.1; 248/519, 158, 160, 159
See application file for complete search history.

(56) References Cited

U.S. PATENT DOCUMENTS

| | | | | | |
|---|---|---|---|---|---|
| 2,949,324 | A * | 8/1960 | Birge et al. | 403/229 |
| 3,437,059 | A * | 4/1969 | James et al. | 108/151 |
| 4,240,766 | A * | 12/1980 | Smith et al. | 404/10 |
| 4,341,488 | A * | 7/1982 | Ryan | 404/10 |
| 4,491,438 | A * | 1/1985 | Berutti | 404/10 |
| 5,540,017 | A * | 7/1996 | Eilam et al. | 52/118 |
| 5,675,956 | A * | 10/1997 | Nevin | 52/726.1 |
| 5,782,040 | A * | 7/1998 | McCartan | 52/98 |
| 5,979,844 | A * | 11/1999 | Hopkins | 248/158 |
| 6,202,369 | B1 * | 3/2001 | Partee et al. | 52/165 |
| 6,216,413 | B1 * | 4/2001 | Lapointe | 52/726.3 |
| 6,712,547 | B1 | 3/2004 | Shauf et al. | |
| 6,745,529 | B2 * | 6/2004 | Beltran | 52/297 |
| 6,969,212 | B1 * | 11/2005 | Richens et al. | 404/10 |

* cited by examiner

*Primary Examiner* — Michael Safavi
(74) *Attorney, Agent, or Firm* — Scott P. Zimmerman, PLLC

(57) ABSTRACT

A cable marker pole system is described for marking the location of buried utility cabling. The cable marker pole system includes a base for embedding in earth or concrete, and a two-part pole assembly that couples with the base. The two-part pole assembly includes a spring coupling the two pole members to allow the pole assembly to flex if struck. A sign is attached to the top of the pole assembly to indicate what is buried.

16 Claims, 6 Drawing Sheets

REPLACEMENT CABLE MARKER POLE HAVING ROTATABLE COLLAR FOR ATTACHMENT OF POLE TO BASE

BACKGROUND OF THE INVENTION

The present invention relates generally to marker poles for subterranean cable installations, and more particularly, to a marker pole having a spring-loaded portion extending above the ground to facilitate movement thereof in response to impacts from motor-vehicles, lawn mowers and the like.

Marker poles are commonly employed for marking the locations of various underground objects. For example, utility lines are often buried in the ground in many locations for aesthetic reasons. Marker poles are placed in the ground and disposed along the buried cable in order to show the location thereof.

In recent years fiber-optic cable networks have been installed in many parts of the country. A common installation procedure involves trenching or boring underground and placing the fiber-optic cables within protective plastic conduit. The fiber-optic cables have many advantages for telecommunications, including the ability to efficiently transmit large amounts of data. However, because relatively high revenues are typically generated from their transfer of correspondingly large amounts of data for telecommunications customers, there exists the potential for large losses in earnings associated with an inoperative fiber-optic cable.

Excavating equipment and operations pose significant threats to buried utility lines, including fiber-optic cables. Natural gas pipelines, for example, pose an explosion risk. Electrical power lines have attendant risks of damage and injuries related to electrical power. Accidentally severing a buried fiber-optic cable can subject an excavation contractor to significant liability for interrupted service. Severing fiber-optic cables can interrupt service unless transmissions can be rerouted. Depending upon the normal traffic volume in a buried cable, significant revenues can be lost before a splice can be made and service restored.

In order to control such risks, utility companies and service providers have marked the locations of their underground lines and provided information regarding same, such as toll-free numbers, which excavators are encouraged to "call before digging". A common pre-existing type of marker includes a length of plastic pipe with one end embedded in the ground and the other end mounting a cap. The cap can have printed thereon warning information, and can be color-coded for the type of buried utility, e.g.: blue—water; yellow—natural gas; red—electric; orange (white)—fiber-optic, etc. Such utility markers tend to be relatively effective and are widely recognized in the art. Although they are relatively easy to install, many of the prior art designs can be easily destroyed by impact with moveable objects.

In view of the foregoing, there exists a need for a marker pole system that exhibits resistance to inadvertent impacts from motor vehicles, lawn mowers, and the like.

SUMMARY OF INVENTION

In accordance with an aspect of the present invention, a cable marker pole system is provided for marking the location of buried utility cabling. The marker pole system generally comprises a base adapted for being embedded in hardened earth or concrete, a two-part pole assembly and a spring. The pole assembly comprises a first elongated member defining a first end and a second end, and a second elongated member defining a first end and a second end. The spring connects the first end of the first member to the first end of the second member. The second member is constructed and arranged to fit within a receptacle defined in the base, such that when the pole assembly is connected to the base, the first member is permitted to move relative to the second member and the base. A sign containing indicia regarding buried cable is attached to the second end of the first member. Several embodiments are disclosed for attaching the pole assembly to the base, a first of which includes a threaded collar associated with the first member for mating with a complimentary threaded portion on the base, a second of which includes a threaded second member and complimentary threaded base receptacle that screw together, and a third of which includes a through-bolt arrangement.

These and other advantages of the invention will be apparent to those of ordinary skill in the art by reference to the following detailed description and the accompanying drawings.

DETAILED DESCRIPTION OF THE PREFERRED EMBODIMENTS

Figure 1A:
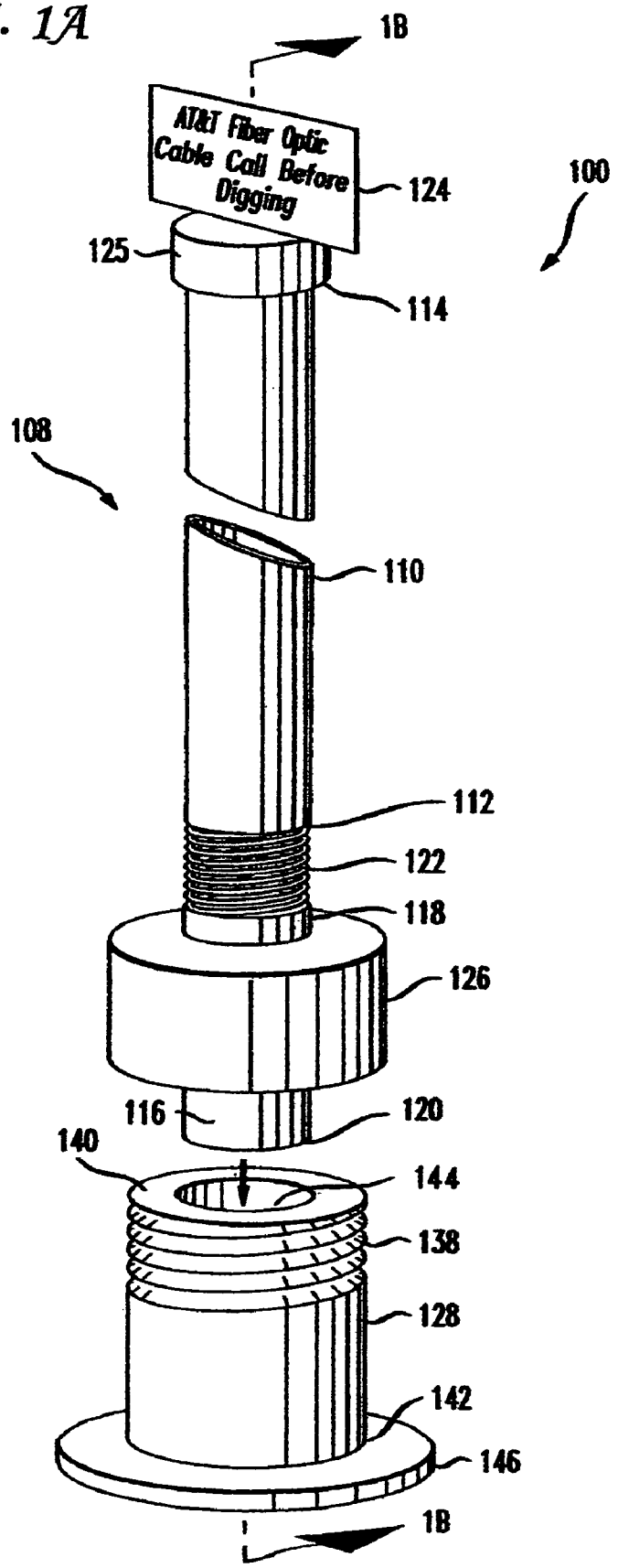
FIG. 1A is an exploded isometric view of a marker pole system in accordance with a first embodiment of the present invention.
Figure 1B:
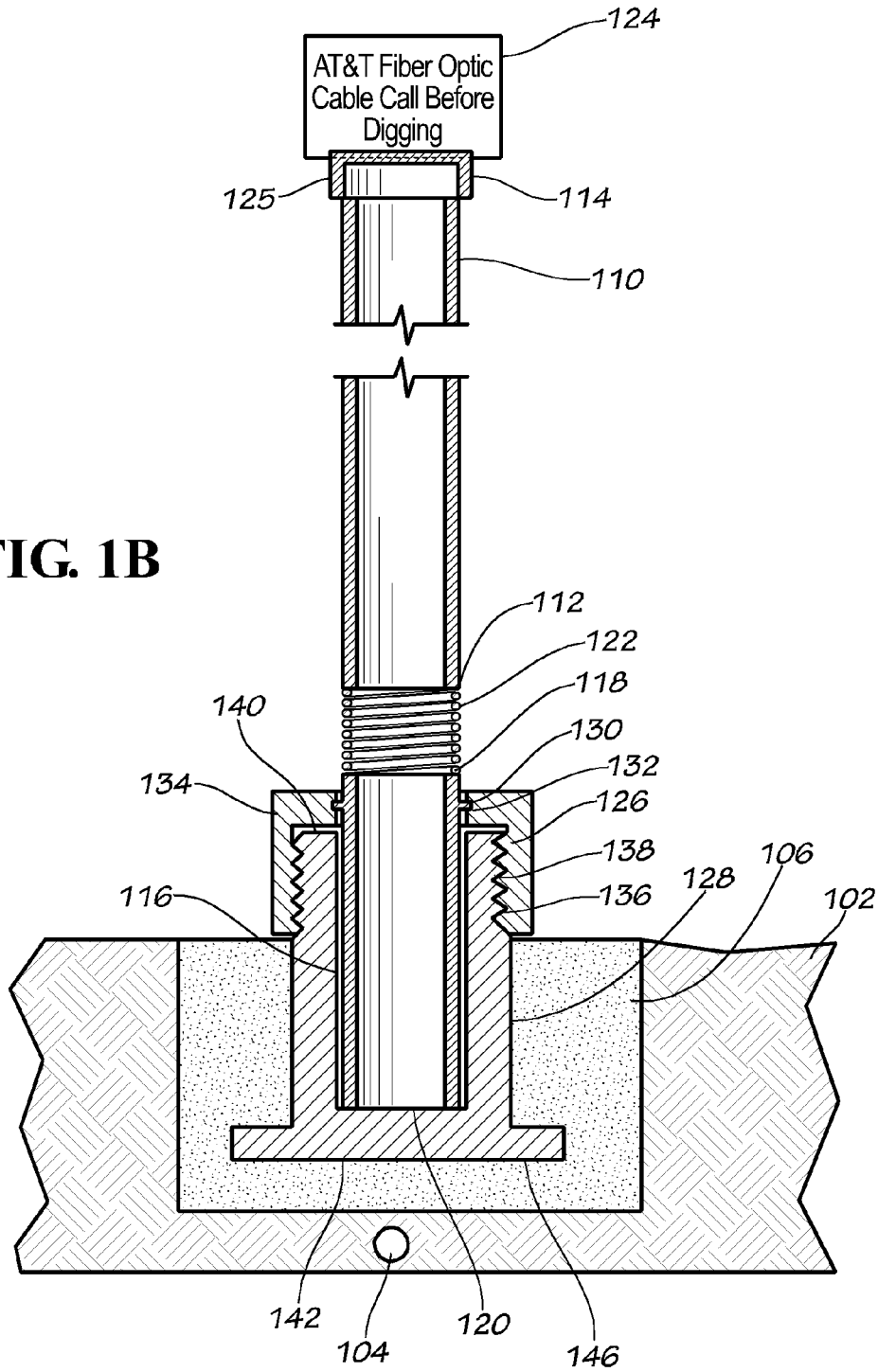
FIG. 1B is a sectional view along lines 1B-1B in FIG. 1A.

FIGS. 1A and 1B depict a first embodiment of a marker pole system 100 in accordance with an aspect of the present invention. The marker pole system 100 is adapted to be partially embedded in the earth 102 over a buried utility line, such as a fiber optic cable 104. The marker pole system may be embedded in hardened earth or concrete generally represented by the reference numeral 106.

The marker pole system 100 includes a pole assembly 108 comprising a first elongated member 110 defining a first end 112 and a second end 114, and a second elongated member 116 defining a first end 118 and a second end 120. The first member 110 is connected to the second member 116 by a coil spring 122 that is attached to the first end 112 of first member 110 and the first end 118 of second member 116, respectively. The first member 110 preferably consists of an elongated section of plastic pipe (e.g., polyvinyl chloride (PVC)), approximately 6 to 8 feet in length. Although a circular tubular body is shown, rectangular or other multisided configurations might be used within the scope of the invention. A sign 124 is affixed to the second end 114 of the first member 110. The sign 124 may have indicia to provide an appropriate warning such as, for example, a "Call Before Digging" advisory with a toll-free number at which additional, pertinent information can be obtained. The sign 124 can be fabricated from a generally flat sheet of plastic material and provided with a cylindrical sleeve 125 for mounting the sign on the second end 114 of the first member 110 as shown.

In accordance with the first embodiment of the invention, a collar 126 is rotatably mounted proximal to the first end 118 of the second member 116. The collar 126 facilitates attachment of the pole assembly 108 to a base 128 that is partially embedded in hardened earth or concrete 106. The collar is provided with a splined or grooved portion 130 that mates with a complimentary splined or grooved portion 132 near the first end 118 of the second member 116. In this manner, the collar 126 can rotate in a fixed position around the second member 116. The collar further includes an annular flange 134 having a threaded portion 136 adapted to mate with a complimentary threaded portion 138 defined in the base 128.

The base 128 is preferably configured as a generally elongated tubular structure having a first end 140, a second end 142, and a centrally disposed elongated receptacle or bore 144 extending therethrough. The base 128 may be provided with a flange 146 to prevent the base from being pulled out of the hardened earth or concrete 106. The base 128 is preferably constructed from galvanized steel, but other materials including plastics or composites may be utilized within the scope of the invention.

The pole assembly 108 is installed in the base 128 by inserting the second end 120 of the second member 116 into the bore 142. The collar 126 and attached second member 116 is then locked to the base 128 by threading the collar 126 over the threaded portion 138 in the base 128. In this manner, the first member 110 is able to move relative to the second member 116 by virtue of the spring 122 in the event of an impact between the first member 110 or sign 124 with motor vehicles, lawn mowers and the like. This freedom of movement enables the pole assembly to survive impacts that would otherwise damage the pole assembly 108.

Figure 2A:
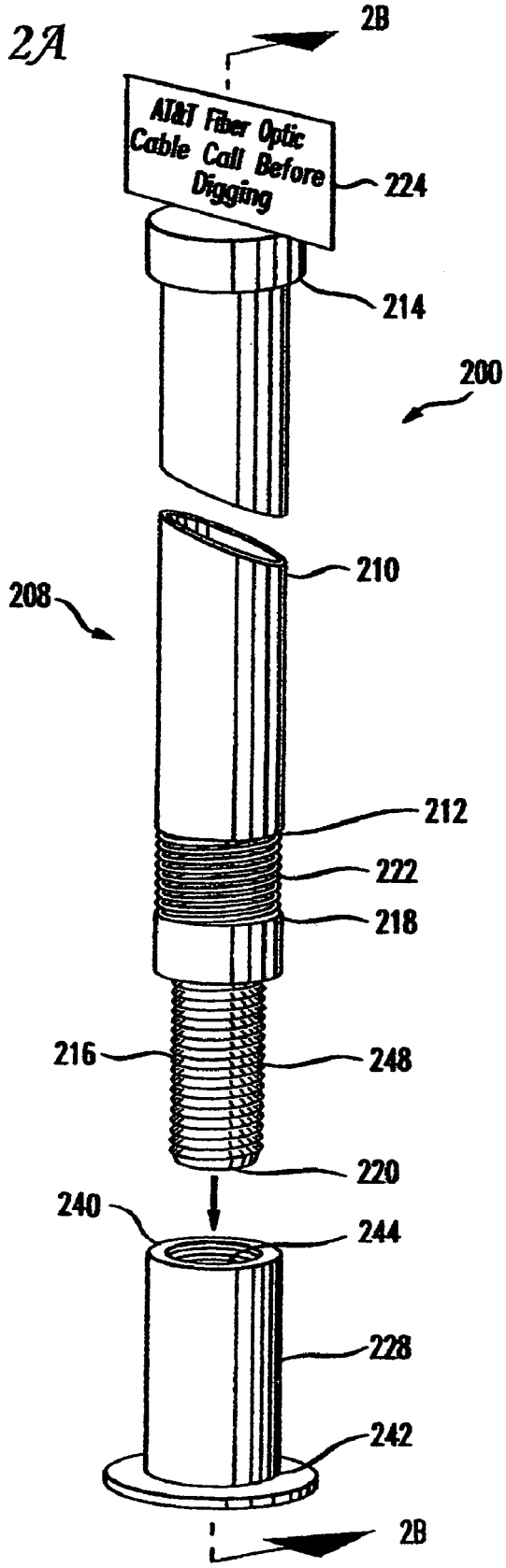
FIG. 2A is an exploded isometric view of a marker pole system in accordance with a second embodiment of the present invention.
Figure 2B:
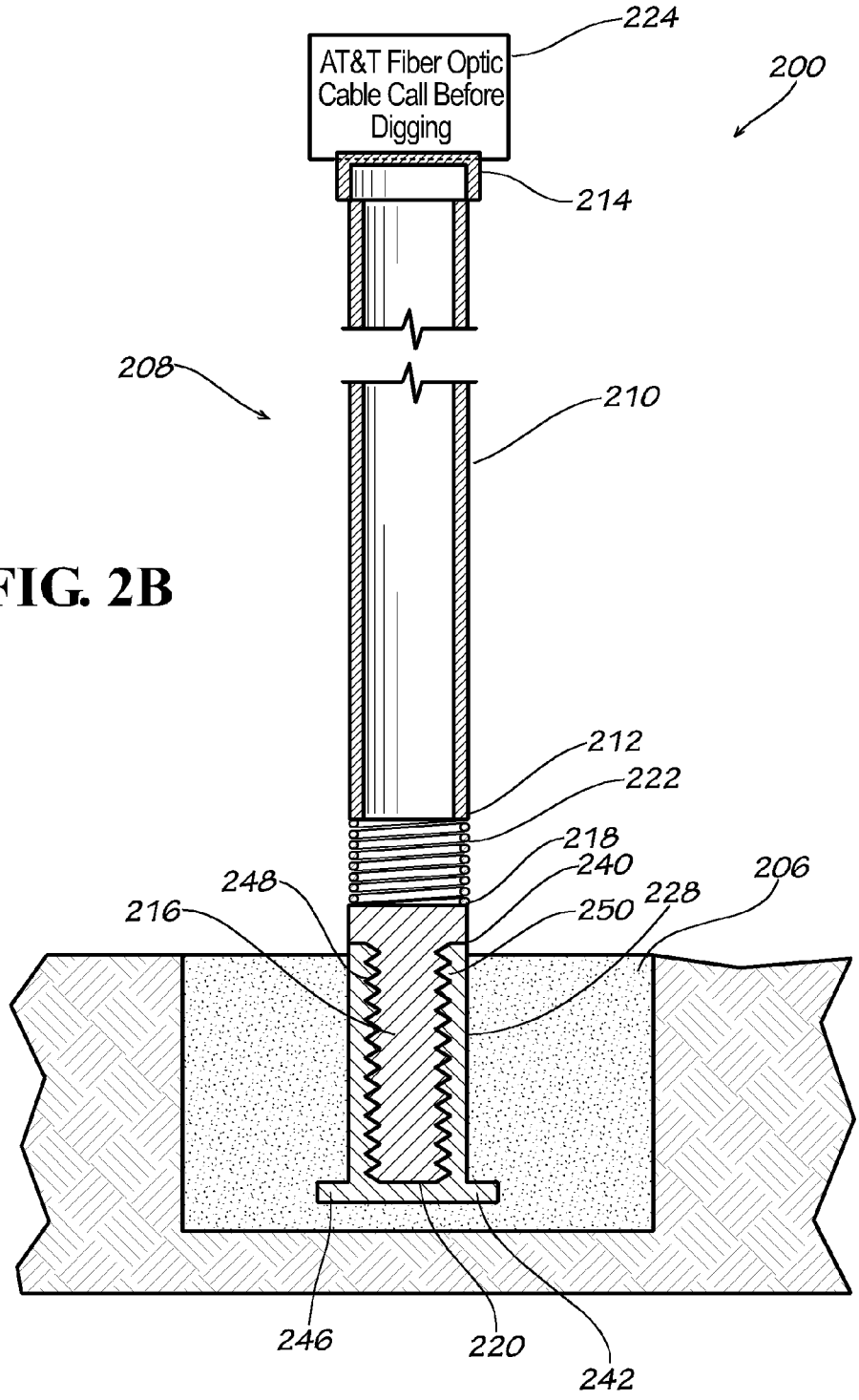
FIG. 2B is a sectional view along lines 2B-2B in FIG. 2A.

Referring now to FIGS. 2A and 2B, there is depicted a second embodiment of a marker pole system 200 in accordance with an aspect of the invention. The marker pole system 200 includes a pole assembly 208 comprising a first elongated member 210 defining a first end 212 and a second end 214, and a second elongated member 216 defining a first end 218 and a second end 220. The first member 210 is connected to the second member 216 by a coil spring 222 that is attached to the first end 212 of first member 210 and the first end 218 of second member 216, respectively. A sign 224 is affixed to the second end 214 of the first member 210. The second member 216 is provided with a threaded portion 248 adapted to mate with a complimentary threaded portion defined in a base 228.

As in the first embodiment, the base 228 is preferably configured as a generally elongated tubular structure having a first end 240, a second end 242, and a centrally disposed elongated receptacle or bore 244 having a threaded portion 250 extending therethrough. The base 228 may be provided with a flange 246 to prevent the base from being pulled out of the hardened earth or concrete 206. The pole assembly 208 is anchored to the base 228 by simply screwing the threaded second member 216 into the threaded bore 244 in the base 228.

Figure 3A:
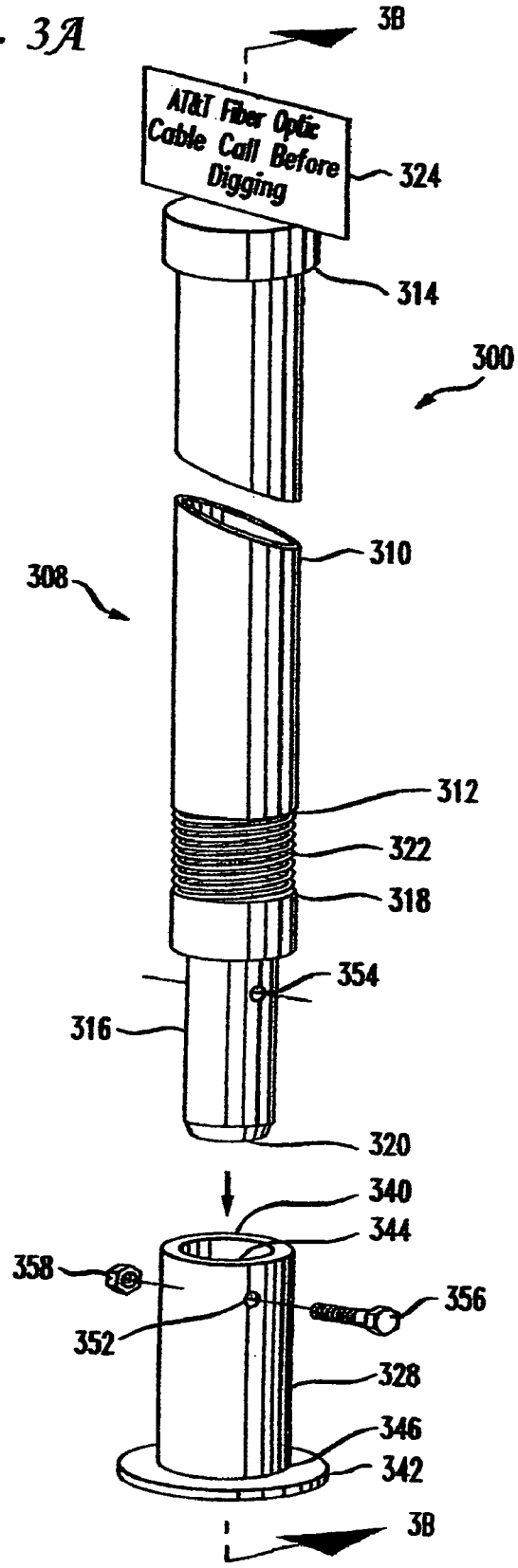
FIG. 3A is an exploded isometric view of a marker pole system in accordance with a third embodiment of the present invention.
Figure 3B:
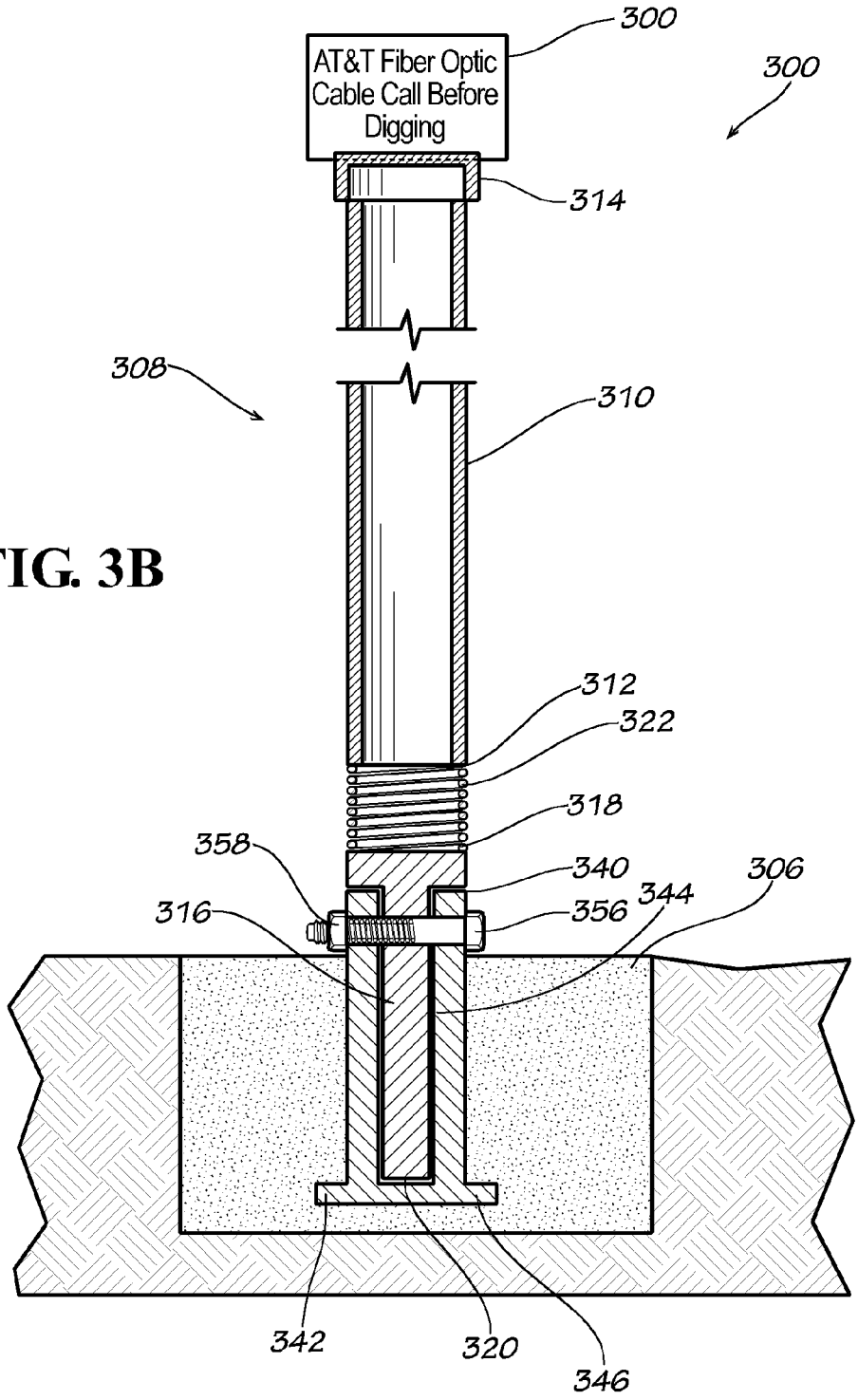
FIG. 3B is a sectional view along lines 3B-3B in FIG. 3A.

Referring now to FIGS. 3A and 3B, there is depicted a third embodiment of a marker pole system 300 in accordance with an aspect of the invention. The marker pole system 300 comprises a pole assembly 308 comprising a first elongated member 310 defining a first end 312 and a second end 314, and a second elongated member 316 defining a first end 318 and a second end 320. The first member 310 is connected to the second member 316 by a coil spring 322 that is attached to the first end 312 of first member 310 and the first end 318 of second member 316, respectively. A sign 324 is affixed to the second end 314 of the first member 310.

A base 328 is preferably configured as a generally elongated tubular structure having a first end 340, a second end 342, and a centrally disposed elongated receptacle or bore 344 sized and adapted for receiving a portion of the second member 316 of the pole assembly 308. As in the first and second embodiments, the base 328 may be provided with a flange 346 to prevent the base from being pulled out of the hardened earth or concrete 306. The pole assembly 308 is installed in the base by inserting the second member 316 into the bore 344 in the base 328. The base 328 has apertures 352 extending transversely through the sidewalls of the base. The second member 316 of the pole assembly 308 includes a mating aperture 354 that is aligned with apertures 352 in the base 328 when the second member 316 is fully inserted into bore 344 of the base 328. A bolt 356 is inserted through the respective apertures 352, 354 and locked down with a nut 358 in a conventional fashion. Of course it will be appreciated by those skilled in the art that many different kinds of fasteners can be utilized in lieu of bolt 356 within the scope of the invention.

The present invention has been shown and described in what are considered to be the most practical and preferred embodiments. It is anticipated, however, that departures may be made therefrom and that obvious modifications will be implemented by those skilled in the art. It will be appreciated that those skilled in the art will be able to devise numerous arrangements and variations which, although not explicitly shown or described herein, embody the principles of the invention and are within their spirit and scope.

We claim:

1. A cable marker pole system for marking the location of buried utility cabling, comprising:

a base defining an elongated receptacle therein and a threaded outer surface;

a pole assembly comprising a first elongated member defining a first end and a second end, a second elongated member defining a first end and a second end, and a spring connecting the first end of the first member to the first end of the second member to allow flexing between the first and second members, the second member adapted to fit within the receptacle defined in the base;

a rotatable collar having a central opening therein through which the second member inserts, the collar having a threaded inner surface that threadably engages the threaded outer surface of the base, the central opening of the collar having an inner wall and an annular groove extending into the inner wall; and the first end of the second member having an outer surface and an annular spline extending from the outer surface, the annular spline mating with the annular groove extending into the inner wall such that the annular spline rotates within the annular groove.

2. The cable marker pole system according to claim 1, further comprising indicia proximate to the second end of the first member.

3. The cable marker pole system according to claim 1, wherein the first member of the pole assemble is fabricated from plastic pipe.

4. The cable marker pole system according to claim 1, wherein the first member of the pole assembly is fabricated from polyvinyl chloride (PVC) pipe.

5. The cable marker pole system according to claim 1, wherein the base is fabricated from steel.

6. A cable marker pole system for marking the location of buried utility cabling, comprising:

a base defining an elongated receptacle therein and having an outer surface including a male threaded portion;

a pole assembly comprising a first elongated member defining a first end and a second end, a second elongated member defining a first end and a second end, and a spring connecting the first end of the first member to the first end of the second member to allow flexing between the first and second members, the second member adapted to fit within the receptacle defined in the base;

a rotatable collar having a central opening therein through which the second member inserts, the collar having a threaded inner surface that threadably engages the threaded outer surface of the base, the central opening of the collar having an inner wall and an annular groove extending into the inner wall;

the first end of the second member having an outer surface and an annular spline extending from the outer surface, the annular spline mating with the annular groove extending into the inner wall such that the annular spline rotates within the annular groove; and a sign containing indicia attached to the second end of the first member.

7. The cable marker pole system according to claim 6, wherein the threaded inner surface of the rotatable collar has a greater diameter than outer surface of the first end of the second member.

8. The cable marker pole system according to claim 6, further comprising a sleeve that slides over the second end of the first member.

9. The cable marker pole system according to claim 6, further comprising a cylindrical sleeve that slides over the second end of the first member, the cylindrical sleeve having an inner diameter greater than an outer diameter of the second end of the first member.

10. The cable marker pole system according to claim 6, wherein the collar comprises an annular flange.

11. The cable marker pole system according to claim 6, wherein the base comprises a flange having a diameter exceeding the outer surface.

12. The cable marker pole system according to claim 6, wherein the base comprises a bottom flange having a diameter that exceeds a collar diameter of the collar.

13. The cable marker pole system according to claim 6, wherein the base is constructed of steel.

14. The cable marker pole system according to claim 6, wherein the base is constructed of plastic.

15. The cable marker pole system according to claim 6, wherein the base is constructed of composite.

16. The cable marker pole system according to claim 6, wherein the elongated receptacle is centrally disposed in the base.

* * * * *